US005960661A

United States Patent [19]

Massée

[11] Patent Number: 5,960,661

[45] Date of Patent: Oct. 5, 1999

[54] APPARATUS FOR WORKING A WORKPIECE

[76] Inventor: Johan Massée, Vijfsprongweg 104, 6741 JC Lunteren, Netherlands

[21] Appl. No.: 09/025,589

[22] Filed: Feb. 18, 1998

[30] Foreign Application Priority Data

Feb. 20, 1997 [NL] Netherlands ..... 1005319

[51] Int. Cl.[6] ..... B21D 22/00

[52] U.S. Cl. ..... 72/81; 72/83; 72/85; 72/421

[58] Field of Search ..... 72/81–85, 420, 72/421, 405.01, 405.05, 405.09, 405.11, 405.12; 483/14, 15

[56] References Cited

U.S. PATENT DOCUMENTS

| | | | |
|---|---|---|---|
| 3,999,495 | 12/1976 | Rouse et al. | 72/421 |
| 4,416,133 | 11/1983 | Doyle | 72/421 |
| 4,449,390 | 5/1984 | Pontini | 72/405.09 |
| 4,742,739 | 5/1988 | Yamaguchi et al. | 82/2 D |
| 5,439,431 | 8/1995 | Hessbruggen et al. | 483/14 |
| 5,537,850 | 7/1996 | Inatani | 72/85 |
| 5,738,005 | 4/1998 | Itakura | 72/405.11 |

FOREIGN PATENT DOCUMENTS

| | | | |
|---|---|---|---|
| 0 125 720 | 11/1984 | European Pat. Off. . | |
| 0 456 951 | 11/1991 | European Pat. Off. . | |
| 29 25 673 | 1/1981 | Germany . | |
| 3402301 | 8/1985 | Germany | 72/85 |
| 34 16 660 | 11/1985 | Germany . | |
| 38 04 656 | 8/1989 | Germany . | |
| 1-218721 | 8/1989 | Japan | 72/83 |
| 2-104434 | 4/1990 | Japan | 72/81 |

*Primary Examiner*—Joseph J. Hail, III
*Assistant Examiner*—Ed Tolan
*Attorney, Agent, or Firm*—Westman, Champlin & Kelly, P.A.; S. Koehler

[57] ABSTRACT

An apparatus for working a workpiece comprises a drive unit for rotating a forming tool about an axis of rotation, a forming roller for working said workpiece, means for moving the forming roller in an x-direction and a y-direction with respect to said drive means, and a control unit comprising a memory for one or more control programs. In this embodiment the axis of rotation of the drive unit coincides with the x-direction. The axis of rotation extends at least substantially in vertical direction. The drive unit and the forming tool can be moved in the x-direction by the moving means.

14 Claims, 7 Drawing Sheets

APPARATUS FOR WORKING A WORKPIECE

BACKGROUND OF THE INVENTION

The invention relates to an apparatus for working a workpiece, which apparatus comprises a drive unit for rotating a forming tool about an axis of rotation, a forming roller for working said workpiece, means for moving the forming roller in a x-direction and a y-direction with respect to said drive unit, and a control unit comprising a memory for one or more control programs.

Such a method and apparatus are known, for example from the applicant's EP-A-0 125 720. The control unit of the apparatus may be arranged in such a manner thereby, that the moving means is controlled in accordance with a control program, so that the forming roller will follow one or more desired paths for transforming the workpiece on the forming tool. The known apparatus commonly includes an ejector or the like for removing the transformed workpiece from the forming tool, whereby said transformed workpiece must usually be transported to a next working station by means of suitable conveyors in order to be subjected to further working steps. With the known apparatus it is generally necessary to transport the workpiece, which has been removed from the forming tool, both in vertical and in horizontal directions, which makes said transport more difficult, and which furthermore makes the positioning of the workpiece a difficult job. Moreover, the position of the workpiece, once it has been released from the forming tool by the ejector or the like, is no longer precisely determined, which makes it relatively difficult to remove the workpiece.

SUMMARY OF THE INVENTION

The object of the invention is to provide an improved apparatus and method of the kind referred to in the introduction, wherein the above drawbacks have been obviated.

In order to accomplish that objective, the apparatus includes a drive unit with an axis of rotation that coincides with the x-direction, and that said axis of rotation extends at least substantially in a vertical direction, whereby the drive unit and the forming tool can be moved in the x-direction by said moving means.

Thus, an apparatus is obtained wherein the transport of the workpiece, during supply and discharge of the workpiece can be limited to a horizontal transport due to the vertical direction of movement of the drive unit and the forming tool.

According to an advantageous embodiment, the drive unit is guided in a housing which is open on the upper side, and whose open upper side is contiguous to an at least substantially horizontal supporting surface. A supply conveyor for a workpiece transports in an at least substantially horizontal plane and connects to one side of the supporting surface. A discharge conveyor for a worked workpiece transports in an at least substantially horizontal plane and preferably connects to one side of the supporting surface.

The invention also relates to a method wherein the features of the apparatus according to the invention are used advantageously for positioning the workpiece in the apparatus. According to the invention, a workpiece is supplied to the apparatus in an at least approximately horizontal plane, until the workpiece is positioned above the forming tool, after which said forming tool is moved upwards in order to pick up the workpiece. Furthermore, a discharge element is preferably moved into the apparatus, under the workpiece that has been transformed on the forming tool. After the working step has been completed, the forming tool is moved downwards for delivering the worked workpiece to the discharge element, after which the discharge element carries away the workpiece from the apparatus in an at least substantially horizontal plane.

BRIEF DESCRIPTION OF THE DRAWINGS

The invention will be explained in more detail hereafter with reference to the drawing, which shows an embodiment of the apparatus according to the invention.

DETAILED DESCRIPTION OF THE PREFERRED EMBODIMENT

Figure 1:
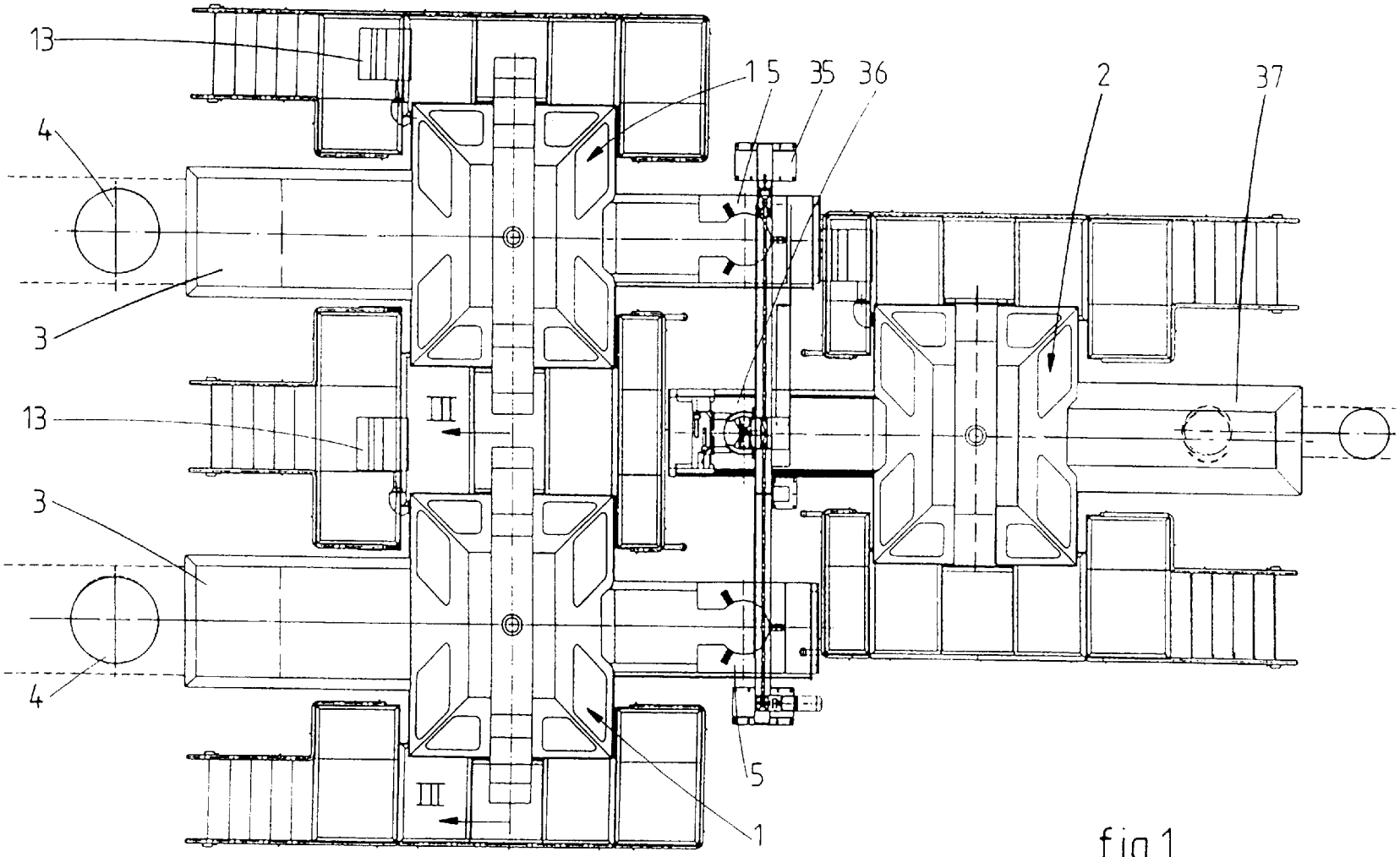
FIG. 1 is a diagrammatic plan view of an installation which is composed of three apparatuses according to the invention.
Figure 2:
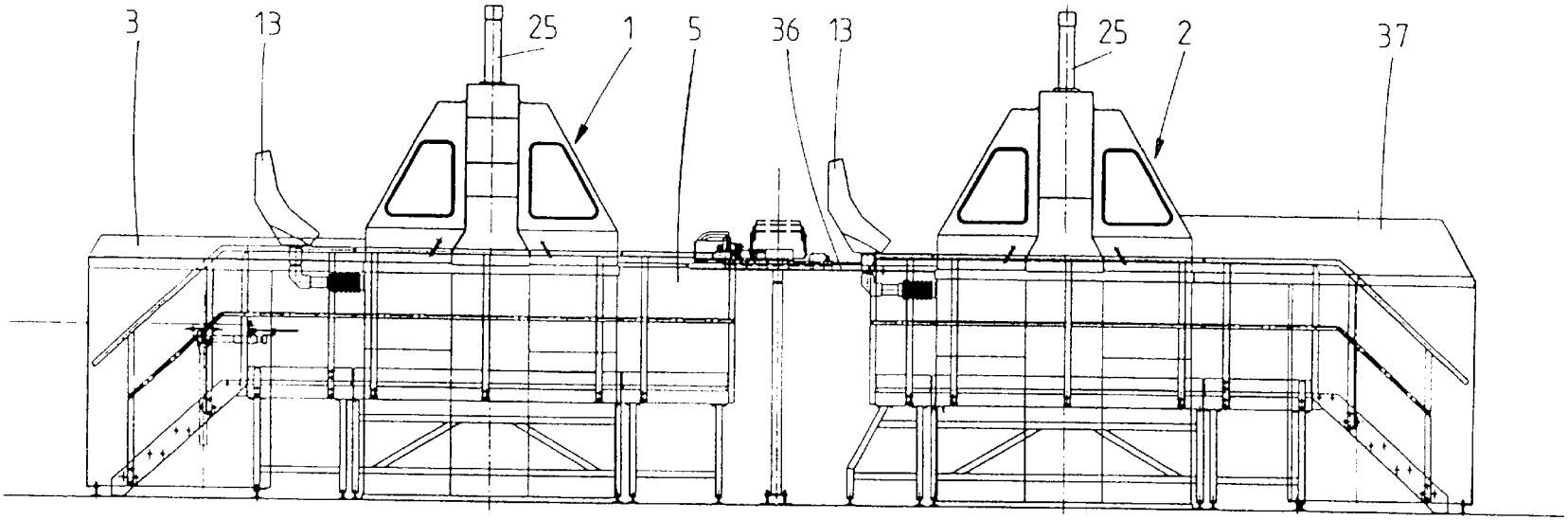
FIG. 2 is a side view of the installation of FIG. 1.

FIGS. 1 and 2 show an installation for manufacturing a product which is composed of three forming machines, wherein two forming machines 1, which are of identical construction, partially manufacture a product, which is subsequently supplied to a third forming machine 2, which carries out a final working step on the product. As is apparent from the plan view of FIG. 1, each forming machine comprises a supply conveyor 3, which supplies a (diagrammatically indicated) workpiece 4, which in this case consists of a metal disc, to the forming machine. Each forming machine 1 furthermore comprises a discharge conveyor 5, which carries the workpiece that has been transformed by the forming machine 1 away from said forming machine 1.

Figure 3:
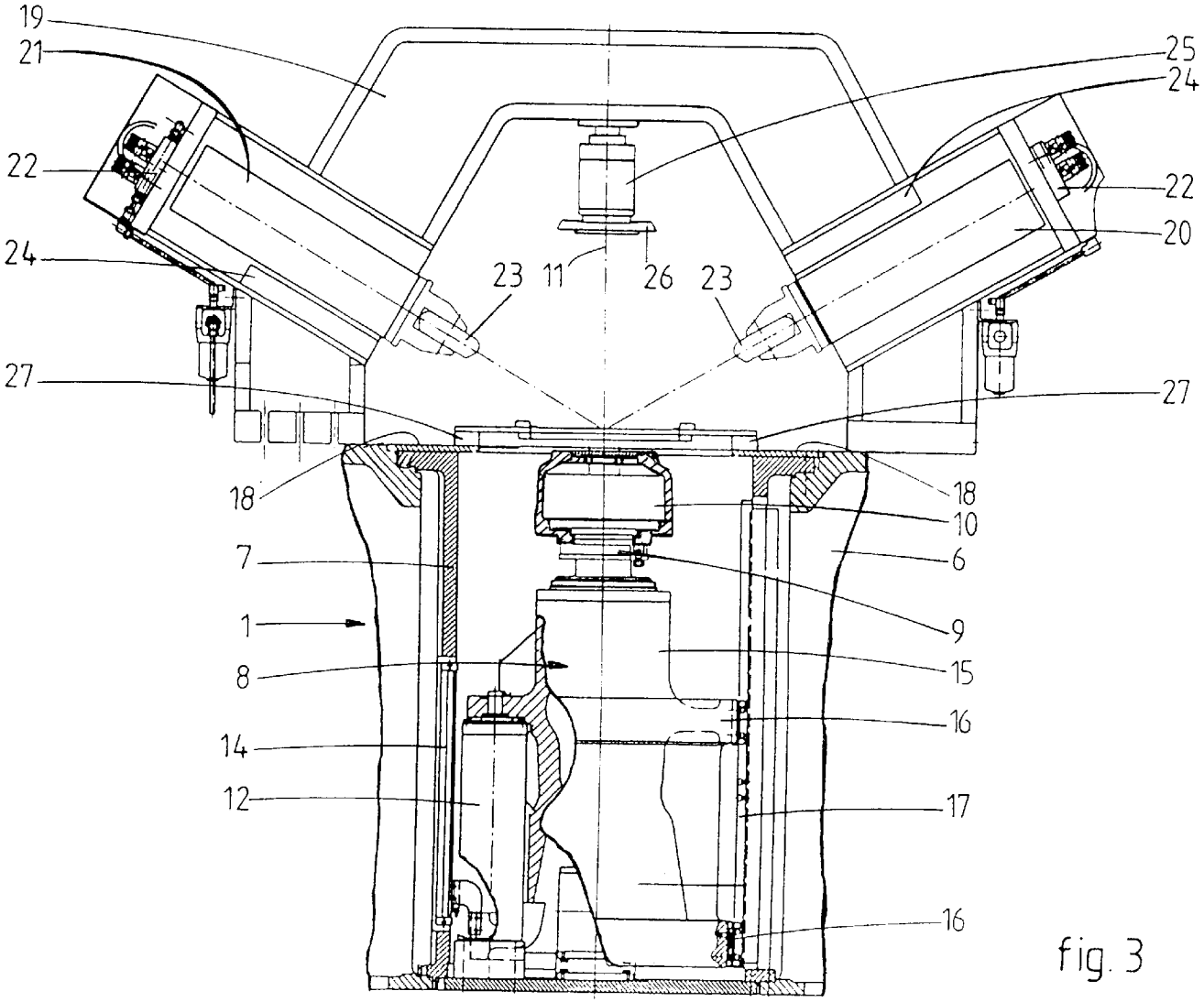
FIG. 3 is a partial sectional view of an apparatus of FIG. 1, taken along line III—III.

FIG. 3 shows one of the forming machines 1 in partial sectional view. The other forming machine 1 is constructed in precisely the same manner. Forming machine 1 comprises an external housing 6 (not shown in detail) and an internal housing 7 positioned within said external housing 6, in which a drive unit 8 is guided. Drive unit 8 is provided with a rotary carrier 9, on which a forming tool 10 is mounted. Carrier 9 and forming tool 10 can be rotated about an axis of rotation 11 by drive unit 8. Said axis of rotation 11 extends in a vertical direction, and coincides with an x-direction, in which direction drive unit 8 can be moved by a hydraulic cylinder 12. Said movement can be controlled by a (diagrammatically indicated) control unit 13 (FIG. 1), and be measured by means of a measuring element or sensor 14.

Drive unit 8 comprises a spindle housing 15, in which carrier 9 is rotatable in bearings. Said spindle housing 15 comprises a number of guide arms 16, which are provided in regularly spaced-apart relationship along the circumference, and which are guided in guide rails 17, which are mounted inside housing 7. Housing 7 has an open upper side, which is contiguous to an at least substantially horizontal supporting surface 18. Mounted on supporting surface 18 is a carrier beam 19, which carries two slides 20, 21 in the present embodiment, which slides can be moved in y-direction by means of a (diagrammatically indicated) hydraulic cylinder 22, and which each carry a forming roller 23. The movement of each slide 20, 21 is measured by a measuring element or sensor 24, which is connected to control unit 13.

Carrier beam 19 carries a clamping unit 25, in line with vertical axis of rotation 11. The clamping unit 25 is provided with a chuck plate 26, which is rotatable about the axis of rotation 11, and by means of which a workpiece 4 can be clamped down on forming tool 10. Workpiece 4 can be given its desired form on forming tool 10 under the control of control unit 13, by moving drive unit 8 in x-direction and moving slides 20, 21 in the respective y-direction. For a further description of some of the functions of control unit 13 reference is made to Applicant's patent application Ser. No. 09/025,497, filed Feb. 18, 1998.

In practice, the above-described forming machine 1 has several advantages, due to the fact that axis of rotation 11 extends in the vertical direction and drive unit 8 is movable in the vertical direction. In the first place, movable drive unit 8 makes it possible to use a compact construction, wherein, in particular, the carrier beam 19 has only a limited height, so that the construction can be made very stiff, which in turn enables precise manufacturing. Furthermore, the transport of the workpieces can remain limited to a substantially horizontal transport in the above-described forming machine 1, which makes precise positioning possible.

Figure 4:
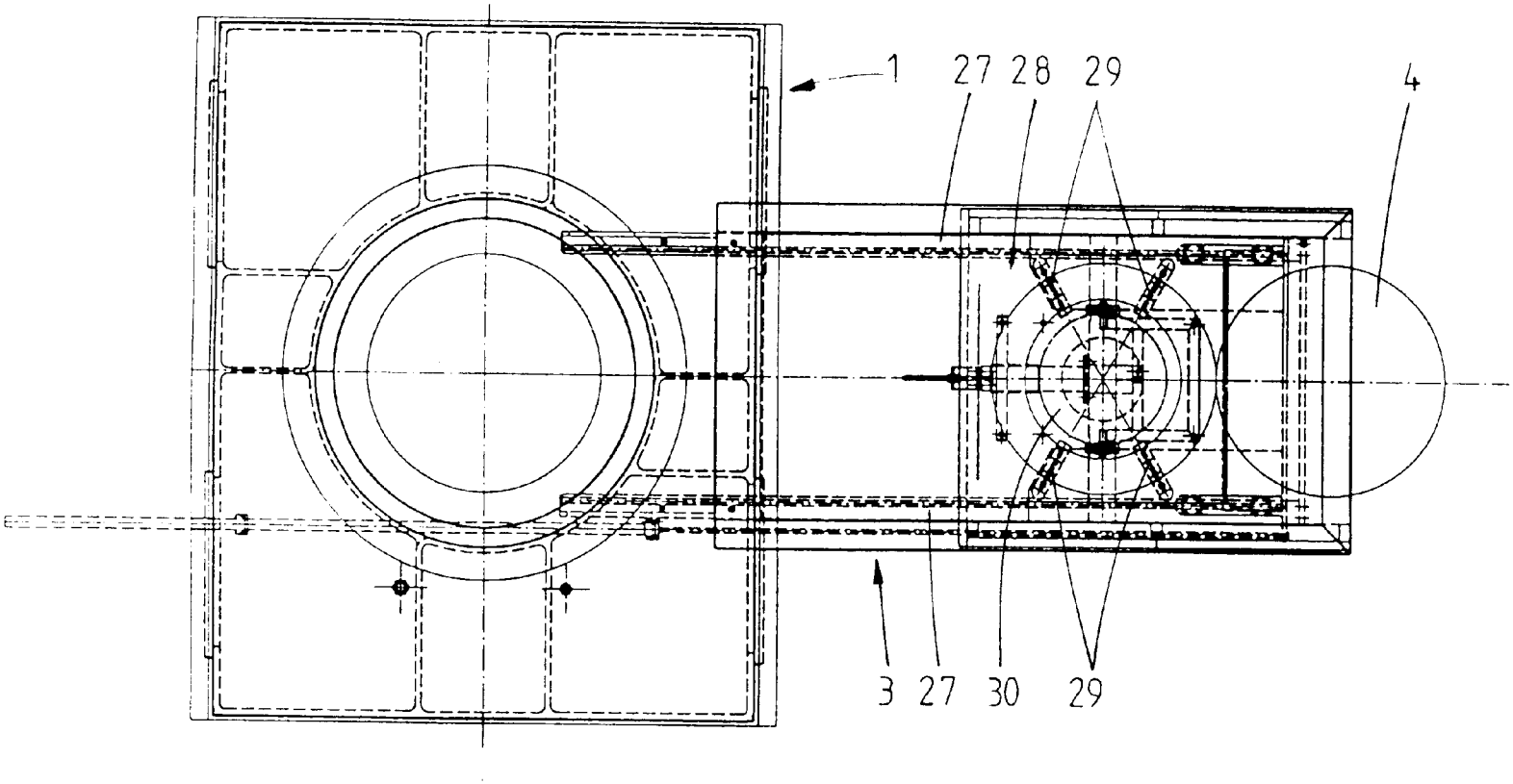
FIG. 4 is a plan view of the apparatus of FIG. 3 and the associated supply conveyor.
Figure 5:
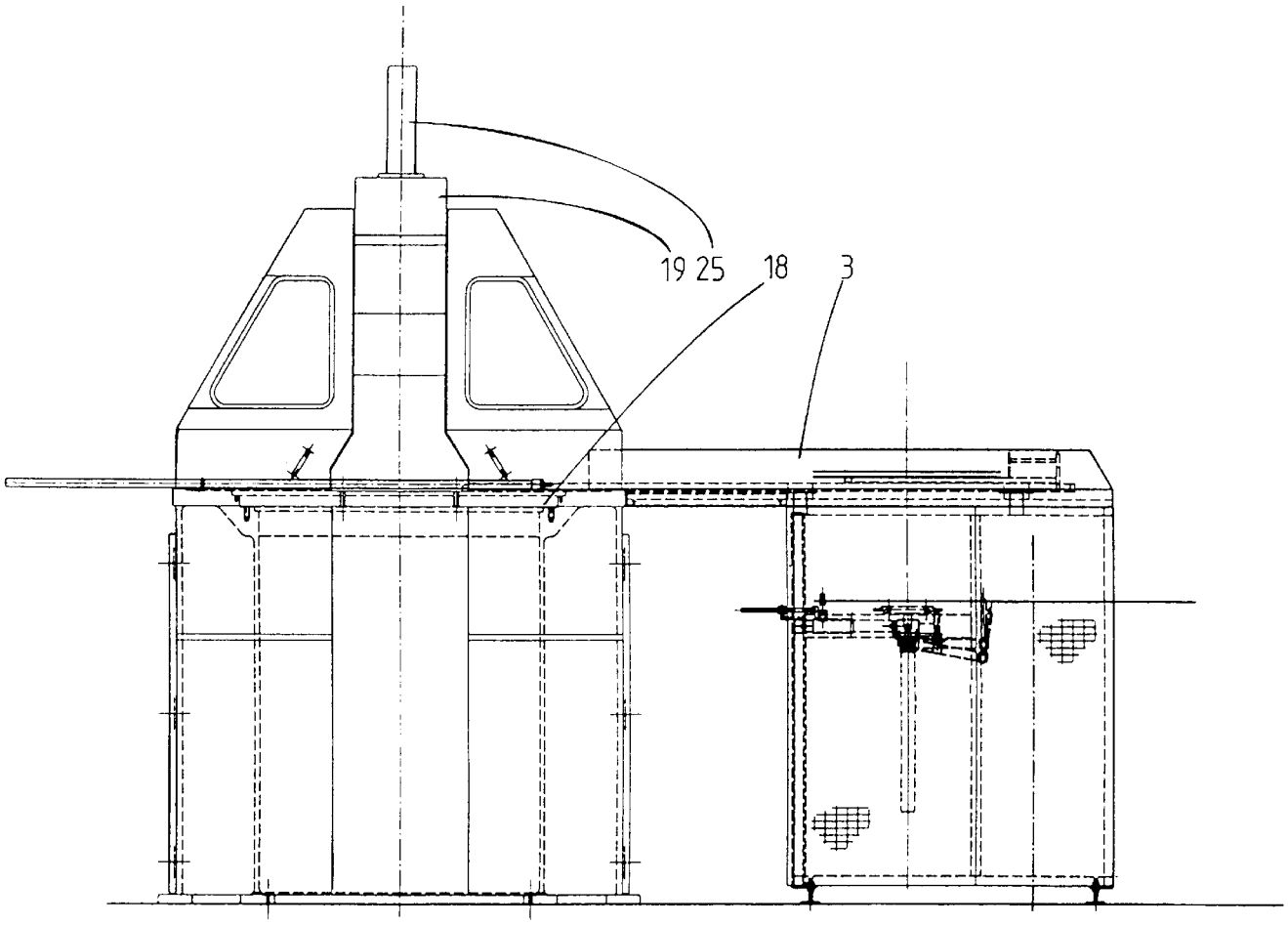
FIG. 5 is a side view of the apparatus of FIG. 4.

As is shown in more detail in FIGS. 4 and 5, supply conveyor 3 connects to horizontal supporting surface 18, whereby supply conveyor 3 transports in the horizontal plane. Supply conveyor 3 comprises rails 27, which are disposed on either side of axis of rotation 11, in which rails a supporting table 28 is movably guided. Supporting table 28 comprises centering elements 29, which center a workpiece 4 with respect to an opening 30. When a workpiece is to be supplied to forming machine 1, supporting table 28 is positioned with its opening 30 centrally above axis of rotation 11, after which drive unit 8 is moved upwards in x-direction, and forming tool 10 picks up workpiece 4 from supporting table 28, after which the supporting table 28 is moved out of the forming machine again.

Figure 6:
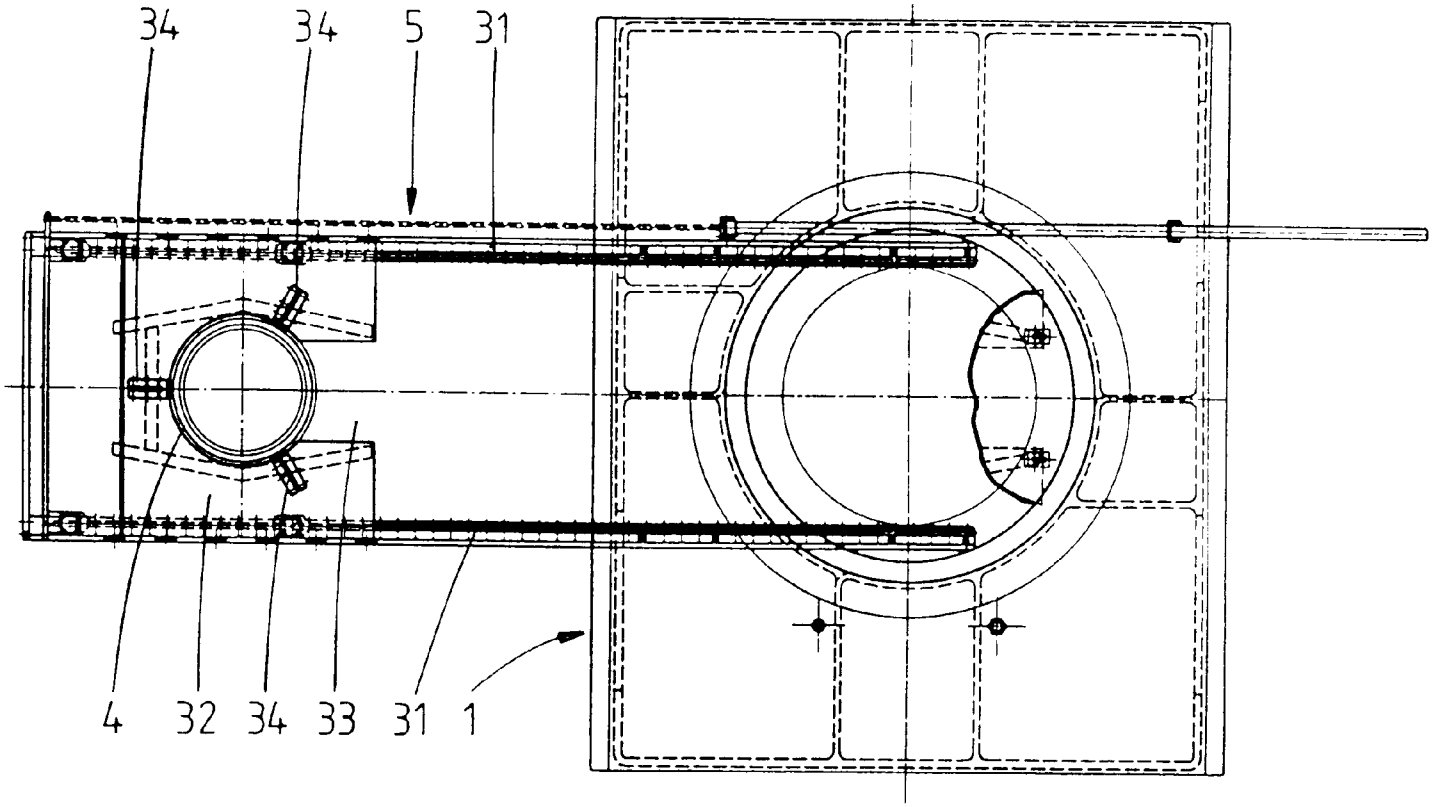
FIG. 6 is a plan view of the apparatus of FIG. 3 and the associated discharge conveyor.
Figure 7:
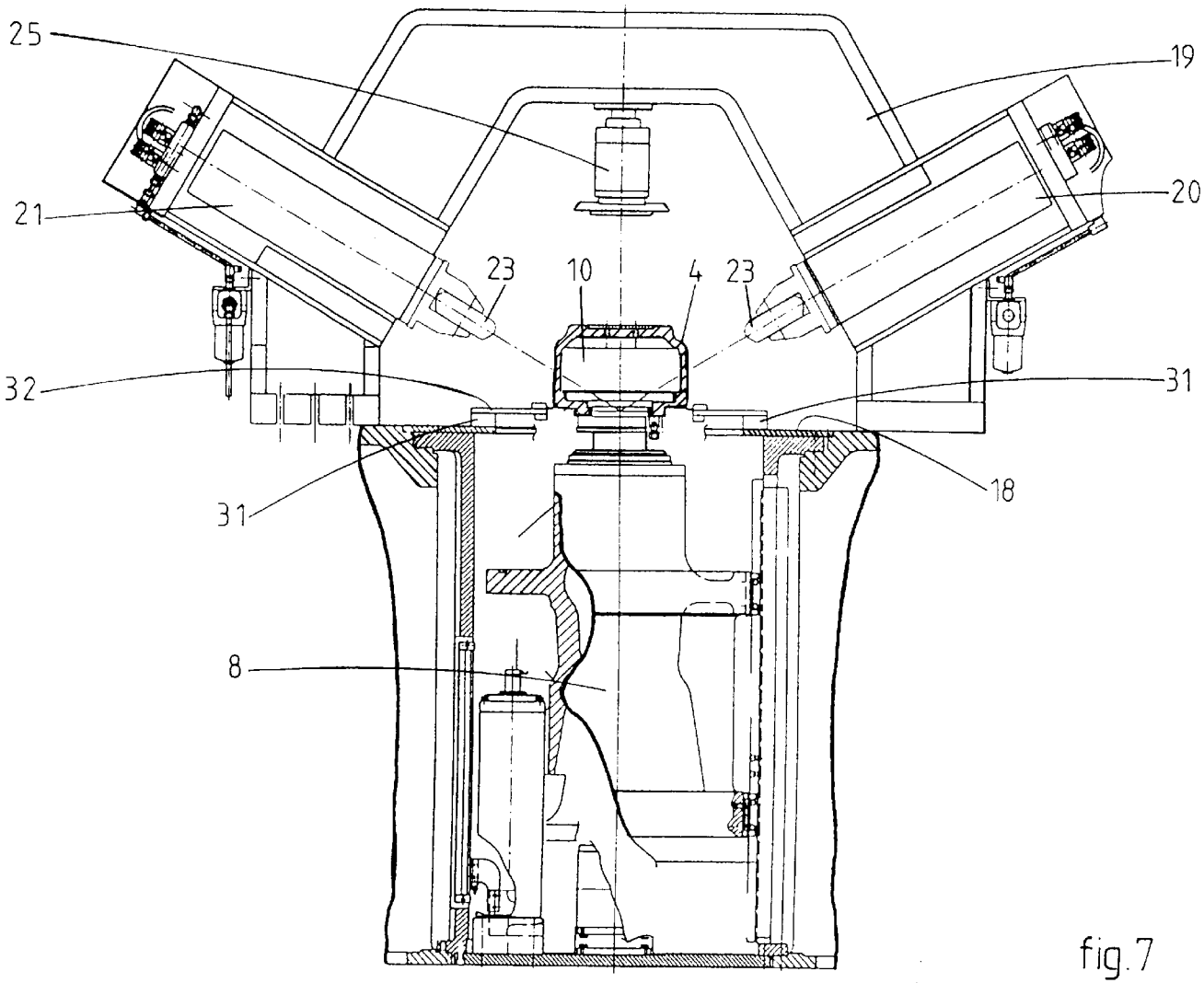
FIG. 7 is a diagrammatic sectional view of the apparatus of FIG. 6, which is shown by way of illustration of the operation of the discharge conveyor.

In a similar manner discharge conveyor 5, which is positioned diametrically opposite supply conveyor 3, connects to supporting surface 18, as illustrated in FIGS. 6 and 7. Also the discharge conveyor 5 transports in a horizontal plane. Said discharge conveyor 5 substantially corresponds with supply conveyor 3, and it comprises rails 31, which are disposed on either side of axis of rotation 11, and which support a supporting table 32. When a worked workpiece 4 is to be discharged from forming machine 1, supporting table 32 is moved into the forming machine 1, whereby forming tool 10 and the workpiece 4 transformed thereon is positioned above supporting table 32. Supporting table 32 is provided with a central opening 33, whose diameter has been selected so that forming tool 10 can pass and workpiece 4 cannot pass. Workpiece 4 is placed onto supporting table 32 by moving drive unit 8 downwards, and held in a precisely determined position by means of centering elements 34.

As is shown in the view of FIG. 1, the two discharge conveyors 5 cooperate with a conveying unit 35, which transports in a direction transversely to the direction of said conveyors 5. The conveying unit 35 supplies the workpieces 4 produced by forming machines 1 to a supply conveyor 36 of forming machine 2. Forming machine 2 carries out a final working step on the workpieces. A discharge conveyor 37 is provided for carrying away the workpieces from forming machine 2. Said conveyors 36, 37 are of substantially similar construction as conveyors 3, 5, and need not be described in more detail herein.

From the foregoing it will be apparent that the transport of the workpieces within the installation of FIG. 1 can take place in a relatively simple manner, whereby an accurate positioning of the workpieces within forming machines 1, 2 is ensured under all circumstances. The vertical movement of drive unit 8 is used advantageously for the transport and positioning of the workpieces 4.

The invention is not limited to the embodiments described above, which can be varied in various ways within the scope of the invention.

I claim:

1. An apparatus for working a workpiece, the apparatus comprising a drive unit for rotating a forming tool about an axis of rotation, moving means for the drive unit and the forming tool, a forming roller for working said workpiece, means for moving the forming roller in an x-direction and a y-direction with respect to said drive unit, and a control unit comprising a memory for one or more control programs, wherein the axis of rotation of the drive unit coincides with the x-direction, and said axis of rotation extends at least substantially in a vertical direction, wherein the drive unit and the forming tool can be moved in said x-direction by said moving means, wherein the drive unit is guided in a housing which is open on an upper side, and whose open upper side is contiguous to an at least substantially horizontal supporting surface, wherein a supply conveyor for a workpiece, which transports at least substantially in a horizontal plane, connects to a first portion of the horizontal supporting surface and wherein a discharge conveyor for a worked workpiece, which transports at least substantially in a horizontal plane, connects to another portion of the horizontal support surface.

2. The apparatus according to claim 1, wherein said supply conveyor comprises a movable supporting table for said workpiece, the supporting table including a central passage for said forming tool.

3. The apparatus according to claim 1, wherein said discharge conveyor comprises a movable supporting table for the worked workpiece, the supporting table including a central passage for said forming tool.

4. The apparatus according to claim 1, wherein a carrier beam is mounted on said horizontal supporting surface, wherein the carrier beam bridges the open upper side of the housing, and which supports a slide for the forming roller, the forming roller being movable in at least the y-direction.

5. The apparatus according to claim 2, wherein the carrier beam supports a clamping unit comprising a chuck plate that is rotatable about said axis of rotation, the clamping unit being capable of movement along said axis of rotation.

6. The apparatus according to claim 1, wherein said drive unit comprises a spindle housing having a plurality of guide arms which are provided in regularly spaced-apart relationship along the circumference of the spindle housing, and wherein the guide arms each co-operate with an associated guide rail that is detachably mounted in said housing.

7. A method for working a workpiece means of an apparatus which comprises a drive unit for rotating a forming tool about an axis of rotation, a forming roller for working said workpiece, means for moving the forming roller in a x-direction and a y-direction with respect to said drive means, and a control unit comprising a memory for one or more control programs, wherein the apparatus is used which comprises the drive unit whose axis of rotation coincides with the x-direction, and which axis of rotation extends at least substantially in a vertical direction, whereby the forming tool can be moved in the vertical direction by moving said drive unit wherein a workpiece is supplied to the apparatus in an at least approximately horizontal plane, until the workpiece is positioned above the forming tool, after which said forming tool is moved upwards in order to pick up the workpiece, wherein a discharge element is moved into the apparatus, under the workpiece that has been transformed on the forming tool, after the working step has been completed, whereby the forming tool is moved downwards for delivering the worked workpiece to the discharge element, after which the discharge element carries away the workpiece from the apparatus in an at least substantially horizontal plane.

8. An apparatus for working a workpiece, the apparatus comprising:

a housing having an opening that opens to a substantially horizontal supporting surface;

a forming roller for working the workpiece;

a first actuator joined to the forming roller for displacing the forming roller to engage the workpiece;

a forming tool;

a drive unit joined to the forming tool for rotating the forming tool about an axis of rotation, the axis of rotation extending through the opening in a vertical direction, the drive unit joined to the housing for guided vertical displacement;

a second actuator joined to the drive unit to vertically displace the drive unit;

a supply conveyor connected to the horizontal support surface to transport workpieces to the forming tool; and a discharge conveyor connected to the horizontal support surface to transport workpieces from the forming tool.

9. The apparatus according to claim 8, wherein said supply conveyor comprises a movable supporting table for said workpiece, the supporting table including a central passage for said forming tool.

10. The apparatus according to claim 8, wherein said discharge conveyor comprises a movable supporting table for the worked workpiece, the supporting table including a central passage for said forming tool.

11. The apparatus according to claim 8, wherein a carrier beam is mounted on said horizontal supporting surface, wherein the carrier beam bridges the opening, and which supports a slide for the forming roller and the first actuator.

12. The apparatus according to claim 11, wherein the carrier beam supports a clamping unit comprising a chuck plate that is rotatable about said axis of rotation, the clamping unit being capable of movement along said axis of rotation.

13. The apparatus according to claim 8, wherein said drive unit comprises a spindle housing having a plurality of guide arms which are provided in regularly spaced-apart relationship along the circumference of the spindle housing, and wherein the guide arms each co-operate with an associated guide rail that is detachably mounted in said housing.

14. A method for working a workpiece comprising:

transporting a workpiece in a substantially horizontal plane to a position disposed above a forming tool of a drive unit having an axis of rotation extending in a vertical direction;

raising the drive unit and the forming tool upwardly in order to pick up the workpiece;

engaging the workpiece with a forming roller to work the workpiece;

positioning a discharge element below the workpiece after the workpiece has been worked; and moving the discharge element and workpiece in a substantially horizontal plane away from the drive unit and forming tool.

* * * * *